US008532320B2

(12) United States Patent
Nordahn et al.

(10) Patent No.: US 8,532,320 B2
(45) Date of Patent: Sep. 10, 2013

(54) METHOD AND SYSTEM FOR FITTING A HEARING AID

(75) Inventors: Morten Agerbaek Nordahn, Broenshoej (DK); Anders Holm Jessen, Glostrup (DK); Jan Topholm, Holte (DK)

(73) Assignee: Widex A/S, Lynge (DK)

( * ) Notice: Subject to any disclaimer, the term of this patent is extended or adjusted under 35 U.S.C. 154(b) by 1508 days.

(21) Appl. No.: 12/103,537

(22) Filed: Apr. 15, 2008

(65) Prior Publication Data

US 2008/0260171 A1 Oct. 23, 2008

Related U.S. Application Data

(63) Continuation-in-part of application No. PCT/EP2005/055305, filed on Oct. 17, 2005.

(51) Int. Cl.
*H04R 25/00* (2006.01)

(52) U.S. Cl.
USPC ..... 381/321; 381/60; 381/318; 381/328; 381/23.1; 381/71.1; 381/58; 381/322

(58) Field of Classification Search
USPC ..... 381/71.1–71.4, 71.6, 322, 60, 23.1, 381/58, 318, 321, 328, 380
See application file for complete search history.

(56) References Cited

U.S. PATENT DOCUMENTS

| | | | | |
|---|---|---|---|---|
| 5,785,661 | A * | 7/1998 | Shennib | 600/559 |
| 6,134,329 | A * | 10/2000 | Gao et al. | 381/60 |
| 6,167,138 | A | 12/2000 | Shennib | |
| 6,236,731 | B1 * | 5/2001 | Brennan et al. | 381/316 |
| 6,792,114 | B1 * | 9/2004 | Kates et al. | 381/60 |
| 7,756,283 | B2 * | 7/2010 | Bramsløw | 381/318 |
| 8,036,392 | B2 | 10/2011 | Frohlich | |
| 2002/0176584 | A1 | 11/2002 | Kates | |
| 2002/0191800 | A1 | 12/2002 | Armstrong | |
| 2007/0036377 | A1 * | 2/2007 | Stirnemann | 381/315 |
| 2009/0274314 | A1 * | 11/2009 | Arndt et al. | 381/60 |
| 2011/0091060 | A1 * | 4/2011 | von Dombrowski et al. | 381/328 |

FOREIGN PATENT DOCUMENTS

| | | | |
|---|---|---|---|
| DE | 4128172 | A1 | 3/1993 |
| WO | WO03043784 | A1 | 4/2003 |

* cited by examiner

*Primary Examiner* — Davetta W Goins
*Assistant Examiner* — Jasmine Pritchard
(74) *Attorney, Agent, or Firm* — Sughrue Mion, PLLC

(57) ABSTRACT

In a method and system for fitting the gain of a hearing aid (300) for a hearing impaired person, a loop gain of the hearing aid in the ear canal (350) of the hearing impaired person is measured for at least one frequency band. An effective vent parameter such as a corresponding vent diameter for the hearing aid by determining a vent parameter that generates the best fit between a modelled and the measured loop gain is estimated, a vent effect value based on the estimated effective vent parameter is determined, and a corrected hearing aid gain is provided by means of the determined vent effect value. The invention provides a method, a computer program, a system for fitting a hearing aid, a hearing aid and a computer system.

20 Claims, 12 Drawing Sheets

METHOD AND SYSTEM FOR FITTING A HEARING AID

RELATED APPLICATIONS

The present application is a continuation-in-part of application No. PCT/EP2005/055305 filed on 17 Oct. 2005, in Denmark and published as WO2007/045271, the contents of which are incorporated hereinto by reference.

BACKGROUND OF THE INVENTION

1. Field of the Invention

Generally, the present invention relates to the field of hearing aids and a method of fitting a hearing aid. The invention more specifically related to a system for estimating otherwise unknown transfer functions for an individual hearing aid. Moreover, the present invention relates to a method and system for adjusting or fitting of a hearing aid using an estimated vent parameter and more particularly to a computer implemented method and a computer system for fitting a hearing aid gain by estimating the best fit acoustic model of the hearing aid by modelling a performed measurement with transmission line theory.

2. Description of the Related Art

WO 03/034784 A1 describes a digital hearing aid system is described where a part of the system is intended for delivering sound into an ear canal of a hearing aid user and this part includes a vent or ventilation canal in order to reduce the occurrence of the known occlusion effect which is often experienced uncomfortable by the hearing aid user.

The geometry of individual ear canals of a hearing aid user interacts with the dimensions of the ventilation canal in determining the acoustic properties and hence the actual gain of the hearing aid.

Even if a hearing aid with a sealed plug is used, because of the individual ear canal geometry a leakage between the ear canal walls and the ear plug of the hearing aid may occur that influences the acoustic properties of the hearing aid. Such a leakage may even occur by using custom-made ear plugs or a hearing aid with a flexible ear plug, for example made by silicon, which normally adapts to the individual ear canal geometry of the user.

The fitting of a hearing aid is normally done by an audiologist in a fitting session in which the hearing threshold levels in certain frequency bands of the future hearing aid user is measured to determine the appropriate hearing aid gain over a frequency range. The frequency dependent measurement of the hearing loss or the so-called hearing threshold level (HTL) may be done by recording an audiogram. An audiogram is the graphical representation of a hearing test. It shows for each ear the minimum sound level required for the future hearing aid user to be able to hear sound per different frequency. The provided sound in the test may be produced by loudspeakers or a hearing aid like device which then also may measure the sound pressure at the eardrum at the hearing threshold.

The necessary gain to be provided by the hearing aid is then calculated based on the audiogram and further fitting rules. However, a leakage or even a ventilation canal (vent) present when using the actual hearing aid influences the sound pressure or other acoustical properties in the ear, and thus the actual gain of the hearing aid may not be properly taken into account in the calculation of the hearing aid gain. Hence, it may be a problem in the state of the art of hearing aid fitting routines that the hearing aid gain is not calculated based on the acoustic properties of the individual ear canal of the user with the actual hearing aid placed in the ear.

Thus, there is a need for improved techniques for fitting a hearing aid taking the acoustic properties of the hearing aid in the individual ear canal of the hearing impaired person into account.

SUMMARY OF THE INVENTION

Today hearing aids are fitted to the user from an idealised condition that covers all individuals irrespective of their individual anatomical differences and hearing aid plugs. This idealised condition is obtained by assuming that any individual ear with any individual plugs behaves like a standard ear plug mounted on a coupler, simulating the average ear. However, there is no such thing as an average ear, and even though fitting today gives a fair estimate on the prescribed gain, several discrepancies persist in the real world. It is therefore an object of the present invention to provide methods and systems capable of providing the possibility for a higher degree of precision in the individual fitting.

A further object of the present invention is to provide a method and system which expand the ability of fitting a hearing aid or adjusting the setting for any possible hearing aid feature.

More particularly, it is an object of the present invention to provide a method and system that fit the hearing aid gain taking the interaction of the geometry of the individual ear canal of a hearing aid user and the geometry of the hearing aid into account.

It is further an object of the present invention to correct the measured hearing threshold, when a so-called in-situ audiogram is recorded.

It is still a further object of the present invention to calculate the needed gain in the hearing aid using the corrected hearing threshold taking account of the acoustic environment.

According to a first aspect of the present invention, a method for fitting a hearing aid gain is provided which comprises the steps for at least one frequency band of measuring a loop gain of an in-situ hearing aid, estimating an effective vent parameter for the hearing aid by determining that vent parameter as said effective vent parameter that provides the best fit between a number of predetermined loop gains and the measured loop gain, calculating a correction gain based on said effective vent parameter, and correcting said hearing aid gain by means of said correction gain.

According to this aspect, the measured measurement of the in-situ transfer function is the loop gain. The loop gain may be measured by using a feedback test. The predetermined pool of hearing aid transfer functions is then any simulated feedback test which replicates the measured in-situ transfer function, vent effect and direct transmission gain. For example, the different hearing aid configurations are represented according to this aspect by different vent parameters.

The predetermined loop gain may be based on modelled data, experimental data, estimates or any combinations thereof. The predetermined loop gains and the corresponding vent effects and direct transmission gains may be entered into tables for faster computation.

The proposed method provides the possibility for a higher degree of precision in the individual fitting, by probing the acoustical surroundings around and/or inside the ear, and estimating possible corrections needed for optimising the individual acoustics of the hearing aid. The most prominent and general of the advantages of the present invention is that the method makes it possible to estimate otherwise unknown acoustic properties or transfer functions for the individual hearing aid when placed in-situ. These estimated functions may be used for fitting purposes or for adjusting the setting for any other hearing aid feature.

The invention, in a second aspect, provides a computer program containing executable program code which, when executed on a computer, executes a method for fitting a hearing aid gain, comprising the following steps for at least one frequency band: measuring a loop gain of an in-situ hearing aid; estimating an effective vent parameter for the hearing aid by determining that vent parameter as said effective vent parameter that provides the best fit between a number of predetermined loop gains and the measured loop gain; calculating a correction gain based on said effective vent parameter; and correcting said hearing aid gain by means of said correction gain.

The invention, in a third aspect, provides a system for fitting a hearing aid which is configured to carrying out a method for fitting a hearing aid gain, comprising the following steps for at least one frequency band: measuring a loop gain of an in-situ hearing aid; estimating an effective vent parameter for the hearing aid by determining that vent parameter as said effective vent parameter that provides the best fit between a number of predetermined loop gains and the measured loop gain; calculating a correction gain based on said effective vent parameter; and correcting said hearing aid gain by means of said correction gain.

The invention, in a fourth aspect, provides a hearing aid adapted for carrying out a method a method for fitting a hearing aid gain, comprising the following steps for at least one frequency band: measuring a loop gain of an in-situ hearing aid; estimating an effective vent parameter for the hearing aid by determining that vent parameter as said effective vent parameter that provides the best fit between a number of predetermined loop gains and the measured loop gain; calculating a correction gain based on said effective vent parameter; and correcting said hearing aid gain by means of said correction gain.

The invention, in a fifth aspect, provides a computer system adapted for being connected to a hearing aid for fitting a hearing aid gain, comprising executable program code including: a program portion for measuring a loop gain of an in-situ hearing aid; a program portion for estimating an effective vent parameter for the hearing aid by determining that vent parameter as effective vent parameter that provides the best fit between a number of predetermined loop gains and the measured loop gain; a program portion for calculating a correction gain based on said effective vent parameter and; a program portion for correcting said hearing aid gain by means of said correction gain.

The computer system is normally applied in a fitting situation in which the hearing aid to be fitted is inserted in the ear canal of the hearing aid user and is also connected to the computer system which comprises executable program code for carrying out a fitting routine. The program code executed on the computer system includes program portions for measuring a loop gain of an in-situ hearing aid, a program portion for estimating an effective vent parameter for the hearing aid by determining that vent parameter as effective vent parameter that provides the best fit between a number of predetermined loop gains and the measured loop gain, a program portion for calculating a correction gain based on said effective vent parameter, and a program portion for correcting said hearing aid gain by means of said correction gain. This fitting routine is carried out at least for one relevant frequency band.

With a method and a computer system according to the present invention it is possible to provide a fitting routine which takes the acoustic properties of the estimated effective vent parameter in a frequency band into account which means that the determined hearing aid gain may be corrected by means of a vent effect that would be otherwise unknown.

Thus, based on a single measurement of a transfer function of an acoustic system like a hearing aid comprising the leakage path including a possibly present vent and a number of assumptions about the acoustic properties of the hearing aid system in-situ, e.g. the receiver type, the dimensions of the sound canal, the ear canal size, the insertion depth, the middle ear properties, the length of the vent and the distance between vent opening and the hearing aid microphone, methods and systems according to the present invention use transmission line theory to select the one of a number of simulated in-situ hearing aids that is most similar to the actual in-situ hearing aid system worn by the user. Based on the estimation of the best fit acoustic model of the hearing aid in-situ by modelling a performed measurement with transmission line theory, in which one or more parameter is varied to give the best fit between measurement and simulation, the entire best fit acoustic system is known, thus allowing the calculation of any transfer function in the hearing aid. The transfer function then provides an effective vent parameter to be used to calculate a correction gain to correct the initial hearing aid gain. The corrected hearing aid gain is then the gain value, which provides the necessary gain for the estimated best fit acoustic model of the hearing aid.

According to a further aspect of the present invention, the vent parameter is sufficiently defined by the vent diameter, but could, according to further aspects, be represented by vent length, vent inductance, vent volume or other mathematical combinations of the vent geometry or leak.

It is a further advantage that the correction of the hearing aid gain is independent of the prescribed fitting rule, which is the recipe of calculating the hearing aid gain from the hearing thresholds.

It is a further advantage that the present invention is applicable for all known types of hearing aids, including BTE, ITE, CIC with any type of earplug or earshell ranging from the tightest full concha plug to a sound tube inserted in the ear.

A further advantage is that the vent effect and the direct transmission gain can be assessed and estimated without any specific knowledge of the individual physical vent size, leakage, insertion depth, ear canal size etc. Should these gain functions—the vent effect and the direct transmission gain—be measured, it would otherwise demand four measurements of the sound pressure with two different sound sources and two different ear plugs (open and closed vent).

It is an even further advantage, that the method according to the present invention provides a more accurate estimated vent effect, than would be obtained if modelling the vent by using its physical vent size. This is because variations in e.g. the ear canal geometry is reflected in the measured transfer function, such as the feedback test, and thus in the effective vent parameter.

The uncontrolled leakage between plug and canal is very difficult to determine in the clinic. Another advantage of the present invention is that in optimising the simulated vent parameter, any leakage, which acoustically behaves much the same way as a vent, will be contained in the effective parameter. For example, in the presence of a leakage, the effective vent would be shorter or wider. This means that the present invention takes the uncontrolled leakage into account when fitting the hearing aid to the user.

Considering the vent effect and the direct sound transmission, parameters such as the vent diameter, the vent length, the insertion depth in the ear canal and the ear canal volume have similar influence, i.e. these parameters move the cut-off frequency of the vent effect. Therefore, any of these parameters could in principle be used as vent parameter. However, since the vent diameter has the most significant influence, and is most intuitively used, it is, according to an embodiment, preferable to use this parameter as the vent parameter.

If, according to an embodiment, the vent diameter is used as the vent parameter, this may imply a difference between the physical vent diameter and the equivalent diameter, even if there is no leakage. Nevertheless, the estimated vent effect of an in-situ hearing aid is approximately the same regardless of the assumed geometry of the simulated ear. This is due to the fact that the best fit between measured and simulated loop gain is equivalent to the best fit between measured and simulated vent effect. Possible discrepancies between physical parameters of the hearing aid and the assumed parameters of the simulated acoustic system, are therefore at least partly accounted for by the variable vent parameter.

Application of a vent correction to the fitting is justified by the fact, that only a few percent of the ordered earplugs or shells have no vent. In other words, since the vast majority of the ordered earplugs or shells comprise a vent (also called venting), the present invention allows for a more accurate fitting for most of the hearing aid users and, therefore, the present invention may elegantly contribute to a better hearing of a wide range of hearing impaired persons.

According to yet another aspect of the present invention, the method further comprises the step of calculating the modelled transfer function by defining the in-situ hearing aid as an acoustic system comprising a plurality of acoustic elements.

According to a particular embodiment of this aspect, the method comprises the step of simulating the modelled loop gain by modelling an acoustic system defining the hearing aid in an ear canal by describing elements of the acoustic system by frequency dependent transmission matrices, multiplying the transmission matrices to a single transmission matrix defining the acoustic system, and calculating at least one transfer function for the acoustic system by using the single transmission matrix. The acoustic system may comprise amplitude correction filter, digital to analogue converter (DAC), hearing aid receiver, sound canal, ear canal, ear drum, ventilation canal (vent), and radiation from the vent exit to a hearing aid microphone and their respective acoustic properties.

According to further aspects, methods and systems of the present invention comprise the step of measuring at least one hearing threshold level (HTL) of the hearing aid user. Such a measurement may be done by recording the HTLs for different frequencies as a frequency dependent hearing loss record. When the hearing threshold levels are directly measured with the hearing aid in the user's ear, the audiogram is also called an in-situ audiogram, or in-situ fitting. The in-situ fitting may have an advantage as the hearing aid is fit under realistic acoustic conditions and therefore gives a good picture of how the hearing aid will probably function in daily use. However, since also the in-situ audiogram does not take into account the vent effect based on e.g. the effective vent parameter such as the vent diameter, also the in-situ audiogram needs to be corrected for the vent effect. Thus, according to an aspect of the present invention, methods and systems are provided for correcting the in-situ audiogram based on the effective vent parameter by measuring a transfer function of the acoustic system including the leakage path, determining a best fit effective vent parameter by simulating the transfer function for different vent parameters, calculating the correction gain with the effective vent parameter, and correcting the in-situ audiogram with the correction gain.

According to another aspect, the corrected hearing aid gain for a user's hearing aid is calculated by deriving a hearing aid gain from the measured hearing threshold level of the user and then correcting the hearing aid gain by adding the vent effect value which will then give a gain when the hearing aid is placed in the ear which takes the vent effect according to the estimated effective vent diameter into account. Normally the vent effect value is a negative gain amount since the vent dampens the sound signal transmitted from the outlet of the receiver back to the inlet of the microphone.

According to another aspect, methods and systems according to the present invention further comprise the determination of a frequency dependent direct sound transmission based on the estimated effective vent parameter and the provision of a corrected hearing aid gain by means of this determined direct sound transmission.

According to another aspect of the present invention there is provided a method and system for estimating the best fit acoustic model of the hearing aid in-situ by modelling a performed measurement with transmission line theory, in which one or more parameter is varied to give the best fit between measurement and simulation. By doing so, the entire best fit acoustic system is known, thus allowing the calculation of any transfer function in the hearing aid.

Further specific variations of the invention are defined by the further dependent claims.

Other aspects and advantages of the present invention will become more apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

Figure 1:
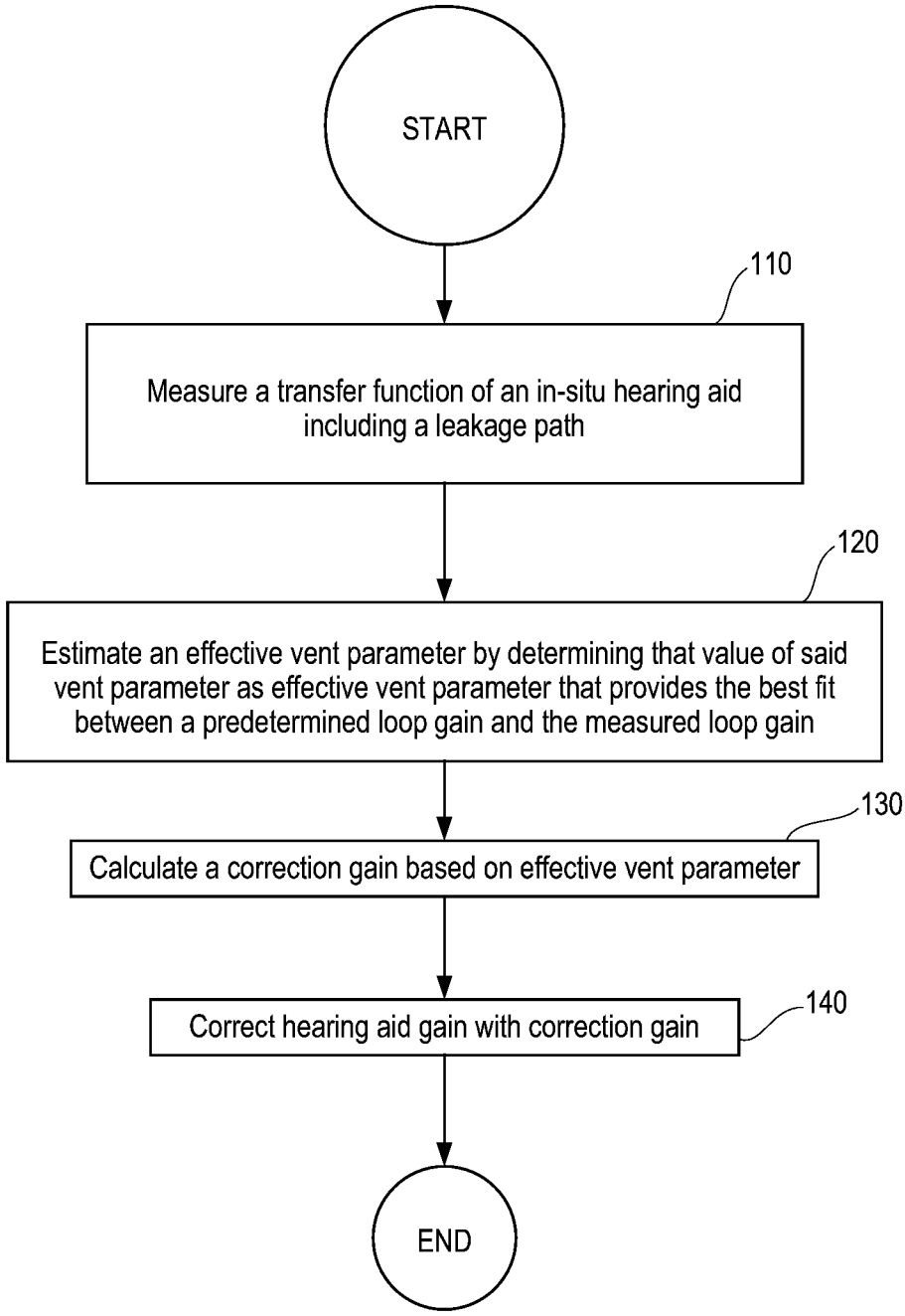
FIG. 1. is a flow diagram of a method according to a first embodiment of the present invention.

Further terms used in connection with the explanation of the present invention will now be defined:

The leakage path is defined as the complete acoustic path from the plane of the sound canal exit to the outside of the ear (or in reverse). The leakage path consists of a controlled leak (e.g. the vent) and an uncontrolled leak between the ear canal and the plug.

The acoustic system is defined as the series of acoustic elements along which the sound can propagate and which is typically initiated by a sound generator and concluded by a sound or vibration sensor.

An acoustic element is defined as block-wise elements within which the acoustic properties are the same. It includes sound generators, such as the receiver, sound mediators such as tubes, the ventilation canal or the ear canal, lumped impedances such as the middle ear and radiation impedance etc. Each element is described mathematically by a 2×2 frequency dependent transmission matrix.

Transmission line theory is a mathematical way of describing an entire acoustic system by acoustic elements, i.e. a cylindrical tube or the receiver. With transmission line theory, the transfer function from one location to another is calculated by multiplying the transmission matrices along an acoustic path from the source to the sensor, taking possible branches into account. The resulting total transmission matrix, which is terminated by the last impedance in the acoustic system (e.g. the ear drum or a radiation impedance), then describes the entire acoustic system.

The transfer function is defined as the ratio between the frequency spectrum of the input to the acoustic system and the measured output signal at a given place in the acoustic system. The input and output signals can either be electrical, mechanical or acoustical. The transfer function is calculated from the total transmission matrix and the terminating impedance. There may be an unlimited number of different transfer functions in an acoustic system.

The effective vent parameter is represented by any parameter that may be used for describing any controlled and/or uncontrolled leakage. The effective vent parameter may thus be defined by one dimension of a vent of arbitrary geometry, e.g. the vent diameter for a cylindrical vent, vent height or width for a rectangular vent, vent length or combinations of the dimensions such as vent volume or vent inductance, etc. This parameter is determined so that it provides approximately the same acoustic properties as the joined forces of the actual ventilation canal of the hearing aid and the leakage between the ear canal walls and the earplug of the hearing aid.

It is an advantage to use the vent diameter as the vent parameter, since it has the similar effect on the vent effect and the direct sound as the vent length, the insertion depth and the residual ear canal volume, and is most intuitively used.

The vent effect is then defined as the sound pressure at the ear drum that is generated by the hearing aid receiver in a sealed ear canal relative to the ear with the respective ear plug with a given vent diameter and length. The vent effect may be simulated resulting in, e.g., a table of gain values for certain possible vent diameters. The vent effect may be expressed as a gain value for each frequency, and may further be calculated for any number of frequency bands for use in the hearing aid.

Direct sound transmission may be defined as the sound pressure at the ear drum that is generated by an acoustic source outside the ear relative to a sound pressure at the exterior vent opening generated by the same source. The value or the values of the direct sound transmission is also called direct transmission gain. Also the direct transmission gain may be simulated by modelling the acoustic system. In the following, if the term direct transmission gain is used it refers to the transfer function with which the hearing aid gain is corrected.

The loop gain represents an in-situ measurement of sound transmitted through an acoustic system comprising the leakage path. The loop gain may be measured by a so-called feedback test, which is normally routinely performed during the fitting routine for estimating the maximum hearing aid gain. The method according to the present invention will therefore, without requiring any additional manoeuvres or measurements, elegantly allow estimating an effective vent parameter for use in the fitting routine.

Hearing aid parameters are parameters defining any feature of the hearing aid as the hearing aid gain, the number of frequency bands, amplitude correction filter, etc. The features may comprise feedback cancelling, noise reduction, compression, etc.

Physical hearing aid configuration defines dimensions of the acoustic coupling to the ear, including receiver type, tubing, ear canal, ear drum, vent etc. as well as electronic configuration of the hearing aid features, including sigma-delta converters, filters etc.

The terms acoustic property or transfer function are also used to define properties of an individual hearing aid which are otherwise unknown and which are used for fitting purposes or for adjusting the setting for any other hearing aid feature. Examples for the acoustic property or transfer function are the loop gain, or any other feedback measurement result.

The equivalent hearing aid configuration is the configuration which gives the best fit between a number of acoustic properties and the respective measured acoustic properties.

A broad aspect of the present invention will now be described referring to specific embodiments and relates to a method in which the measurement of an arbitrary user worn hearing aid is performed and compared to a pool of predetermined trials of hearing aid transfer functions. The predetermined pool contains a number of sets of predetermined transfer functions for several materialisations of possible physical hearing aid configurations. One of these various predetermined transfer functions is similar to the measured in-situ hearing aid transfer function. An error between the measured in-situ hearing aid transfer function and each of the corresponding predetermined transfer functions is calculated, and the least error defines the best fit. This best fit represents a certain physical hearing aid configuration, for which any other transfer function may be determined. In doing so, any transfer function in the in-situ hearing aid may be estimated from measurement of only one transfer function.

The measurement of the in-situ transfer function could be exemplified by any probe sensor measuring the sound inside the ear canal, inside the earplug or along the tubing, in the hearing aid or in the vicinity of the outer ear and pinna. The probe sensor may sense vibration, sound or other, and could be part of the hearing aid or an external device. The generator for the measured sound may be the hearing aid receiver, an external sound source or the voice of the hearing aid user. An example could be the feedback test of the hearing aid.

The pool of predetermined trials of hearing aid transfer functions may be established through measurements, estimates or simulations. The important thing is that a set of transfer functions is determined for each physical hearing aid configuration, or put differently, each transfer function is determined for a set of physical hearing aid configurations. One of these transfer functions must replicate the measurement of the in-situ transfer function. Examples of the trial transfer function may include the feedback test, for fitting with the measured transfer function, the vent effect, the direct transmission gain, the occlusion effect etc.

According to a particular embodiment, if the predetermined trials are established through measurements, this could be accomplished, e.g. by taking a person with an 'average' ear, insert a number of plugs with different properties and making measurements that replicate the in-situ measurement for each plug. Simultaneously, other relevant transfer functions are measured for each plug.

According to another embodiment, if the predetermined trials are established through estimates, this could be accomplished by using tables from the literature, using empirical experience or other for guessing on the relevant transfer functions. According to still another embodiment, if the predetermined trials are established through simulations, this could be accomplished by using e.g. transmission line theory to model every part of the acoustic system as closely as possible, and vary a certain representative parameter, such as the vent diameter. In this way, any transfer function can in principle be calculated.

The physical hearing aid configuration is determined by both dimensions of the acoustic coupling to the ear, including receiver type, tubing, ear canal, ear drum, vent etc. and electronic configuration of the hearing aid features, including sigma-delta converters, filters etc.

Figure 7A:
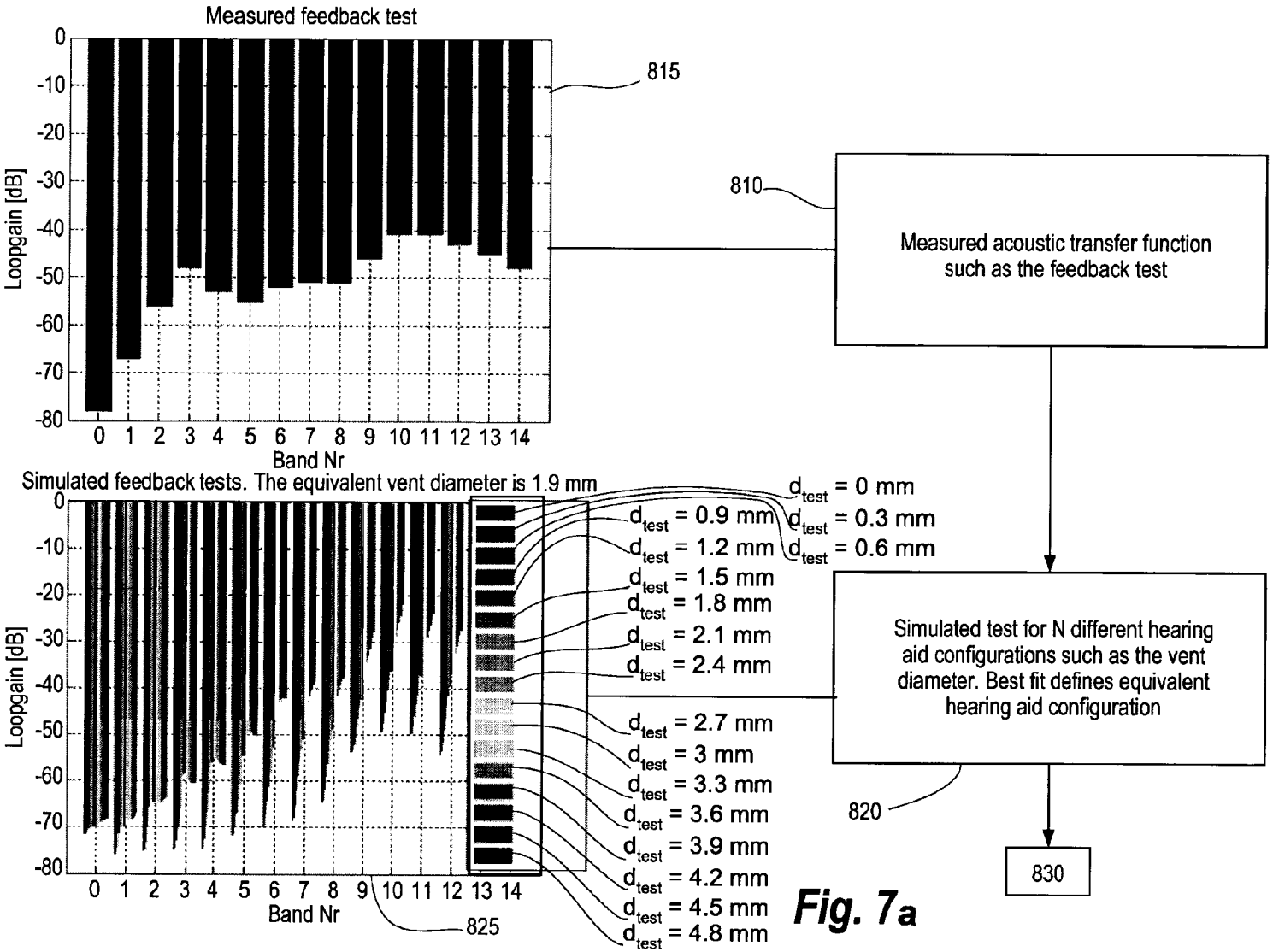
FIG. 7*a* illustrates a flow diagram of a method for deriving an estimated transfer function comprising steps for simulating tests of hearing aid configurations.
Figure 7B:
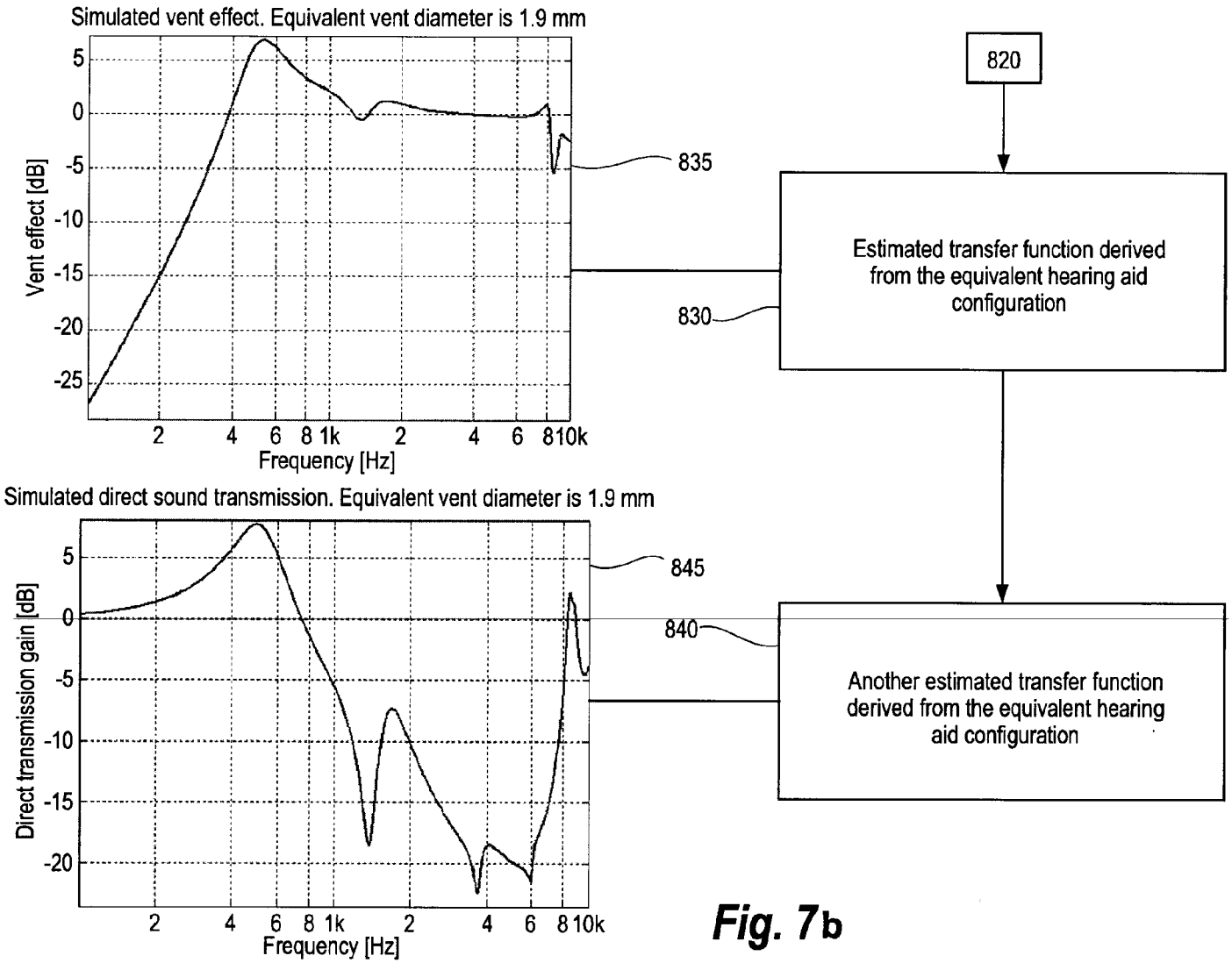
FIG. 7*b* illustrates a flow diagram of a method for deriving an estimated transfer function comprising steps for determining the estimated transfer function.

With reference to FIG. 7 an embodiment of the present invention will now be described. FIG. 7 explains how an estimated transfer function or acoustic property is derived from an equivalent hearing aid configuration. In step 810 an acoustic transfer function of an in-situ hearing aid is measured. The acoustic transfer function is, for example, a measured feedback test as illustrated in diagram 815. For each of N different hearing aid configurations varied e.g. with respect to the vent diameter a respective test is then simulated in step 820. Diagram 825 shows by way of example the result of such simulated feedback tests. The hearing aid configuration of the simulated test that provides the best fit with the measured transfer function defines the equivalent hearing aid configuration. In diagram 825, as equivalent hearing aid configuration the equivalent vent diameter is 1.9 $mm^2$. In step 830, from the equivalent hearing aid configuration the estimated transfer function is then determined. In the present example, the determined transfer function is the vent effect as illustrated in diagram 835. As further illustrated in diagram 845, it is possible by the present invention to derive any further estimated transfer function such as the direct sound transmission from the equivalent hearing aid configuration and, therefore, to determine any transfer function or acoustic property of the hearing aid which would otherwise be unknown (step 840).

The aspect of the present invention relating to improved approaches to the fitting of a hearing aid gain by use of an estimated vent parameter will now be described referring to specific embodiments.

There is provided a method and system for assessing unmeasured otherwise unknown acoustic transfer functions in the hearing aid, e.g. yielding information about the ear-drum sound pressure and the acoustic consequences of a vent, the amount of directly transmitted sound through the vent, or the risk of feedback. The methods and systems described are in particular applicable for fitting an in-situ hearing aid with a custom sound canal-, vent- and ear canal geometry including middle ear properties.

Figure 4A:
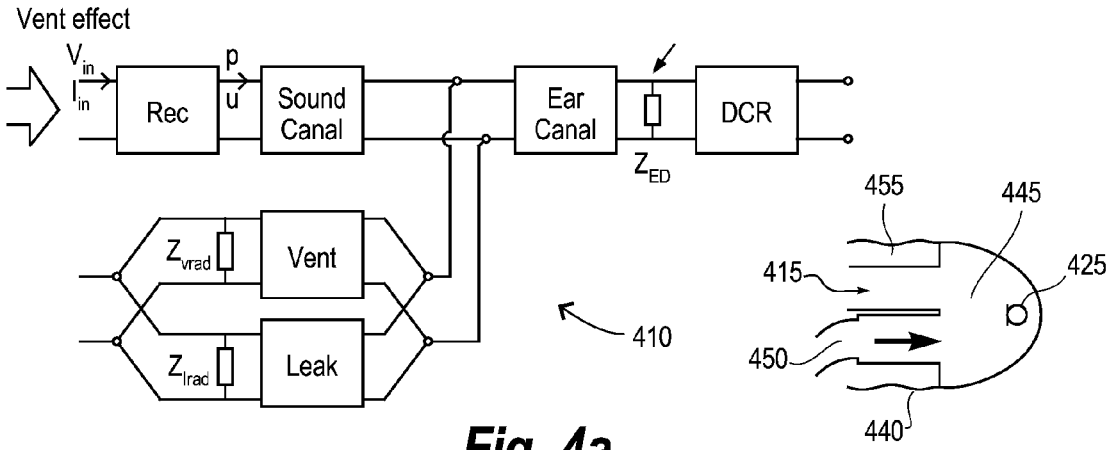
FIG. 4*a* illustrates an equivalent circuit for modelling the vent effect.
Figure 4B:
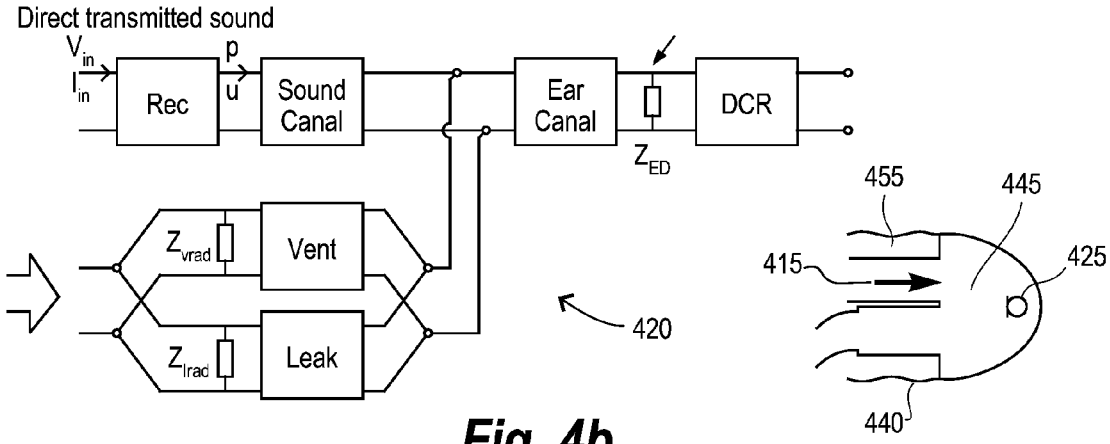
FIG. 4*b* illustrates an equivalent circuit for modelling the direct transmission gain.
Figure 4C:
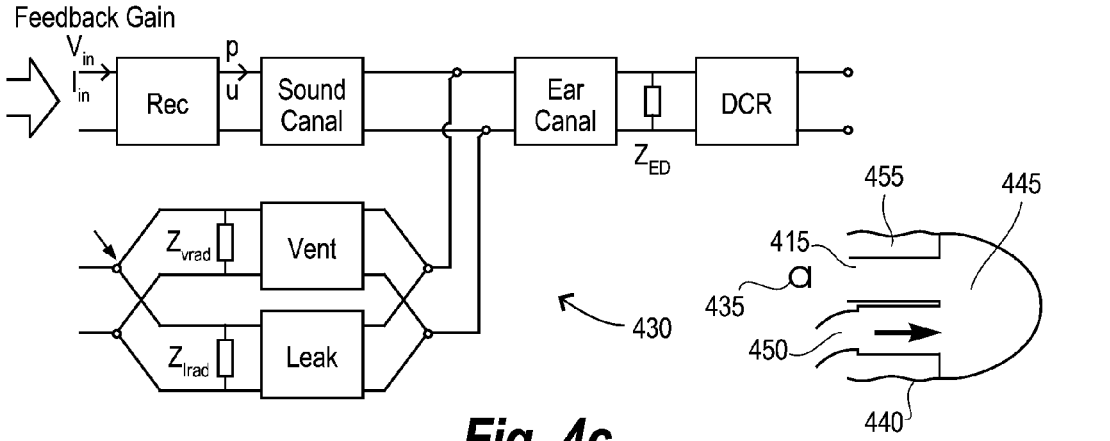
FIG. 4*c* illustrates an equivalent circuit for modelling the acoustic part of the loop gain.

Information about a specific geometric parameter of the leakage path can be obtained through measurements of a transfer function in an acoustic system including the leakage path. FIGS. 4*a*, 4*b* and 4*c* show examples of calculated transfer functions.

In obtaining information about a parameter of a corresponding geometry of the leakage path lies assumptions or measurements of the parameter and/or acoustic properties of the various parts comprising the entire acoustic system. These parts are simulated in a modelled acoustic system, where each part in the acoustic system is described by an acoustic element. The model is built so that the simulated acoustic system describes the measured acoustic system part for part, and so that the simulated transfer function corresponds to the measured transfer function. At least one parameter (e.g. vent diameter) is free and used as optimisation parameter to yield the best fit between simulated and measured data. With the optimally fitted simulated acoustic system, any transfer function within the simulated acoustic system may be calculated and implemented in the fitting routine or other.

FIG. 1 shows a flow diagram 100 of a fitting routine for fitting the gain of a hearing aid for a hearing aid user according to a first embodiment of the invention. The fitting routine is preferably a computer implemented method carried out, for example, under control or supervision of an audiologist during a fitting session when fitting and adjusting the hearing aid to the degree of hearing loss and further requirements of the user.

In a first step 110, a transfer function of an in-situ hearing aid including a leakage path is measured to determine the hearing aid including its leakage path by its acoustic properties as an acoustic system. According to another embodiment, this is implemented by measuring the maximum possible loop gain for the concrete hearing aid placed in the ear canal of the user. The measurement of the loop gain may be done by carrying out a so-called measured feedback test to determine the maximum gain amount before feedback occurs for a certain frequency.

Then, an effective vent parameter for the hearing aid is estimated in step 120 by determining that value of the vent parameter as effective vent parameter that provides the best fit between a modelled and the measured transfer function. According to another embodiment, the effective vent parameter is an effective vent diameter which is estimated by determining a vent diameter that generates the best fit between a predetermined and the measured loop gain. The modelled loop gain is determined by simulating a model of the acoustic system with different values for an assumed vent diameter. The predetermined or modelled loop gain values are then compared with the measured loop gain to determine a vent diameter corresponding to the modelled loop gain that is equal to or fits best to the measured loop gain for the respective frequency and which is therefore estimated as the effective vent diameter. The so estimated effective vent diameter thus takes not only the possible ventilation canal in the hearing aid but also any other leakage or further acoustic properties resulting from the actual situation in the ear canal of the user with inserted hearing aid into account.

Based on the effective vent parameter a correction gain is calculated in step 130. According to the embodiment using the estimated effective vent diameter, a vent effect is calculated as the correction gain. The vent effect is a (negative) gain amount defining the damping from the outlet of the receiver of the hearing aid back to the inlet of the microphone based on the estimated effective vent diameter or geometry. In a next step 140, the hearing aid is corrected with the correction gain. The so corrected hearing aid gain may then be used to fit the hearing aid taking the acoustic properties of both the hearing aid and the geometry of the individual ear canal of the hearing aid user into account. According to the embodiment determining the vent effect, the hearing aid gain is corrected by means of the determined vent effect to provide a corrected hearing aid gain for a certain frequency or frequency range.

The hearing aid gain to be corrected is, according to an embodiment, derived from a hearing test like an audiogram as the necessary gain to compensate for the hearing loss. According to an embodiment, the audiogram is also recorded during the fitting session. According to another embodiment, the initial hearing aid gain to compensate for the hearing loss has already been derived in another session, e.g. when measuring an audiogram for the first time to evaluate a possible hearing loss.

Figure 2:
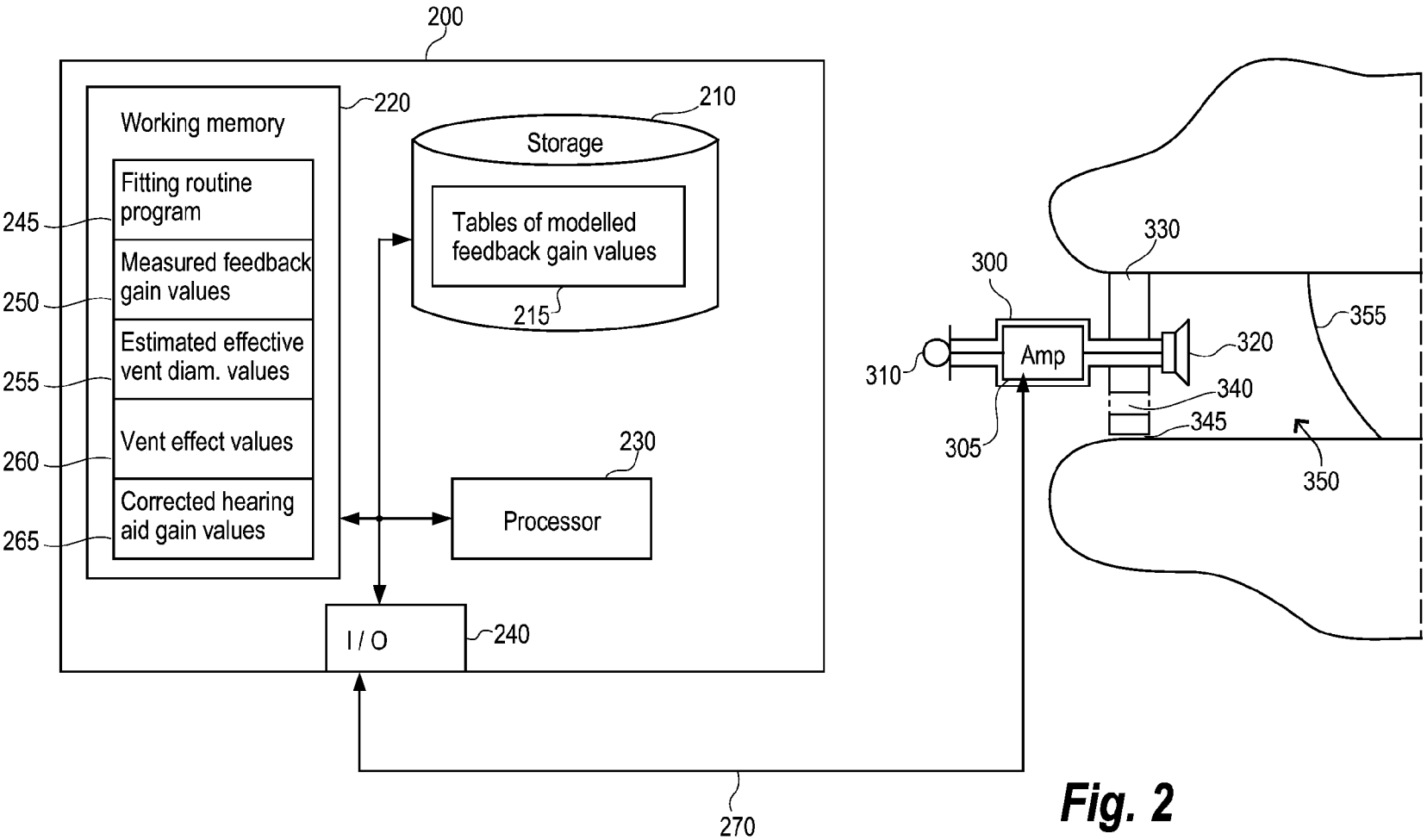
FIG. 2 is a schematic block diagram of a system according to another embodiment of the present invention.

FIG. 2 shows, in schematic form, a block diagram 200 of a computer system connected via its I/O unit and connection means 270 to a hearing aid 300 inserted in ear canal 350 of the user. A computer system 200 is configured to carrying out the fitting routine according to embodiments of the present invention. When equipped as a computer, it has a processor 230 for processing the computer implemented fitting routine program 245 stored in a working memory 220, and a storage 210 for storing, e.g., modelled loop gain values for different possible vent diameters and frequencies in tables 215.

The hearing aid 300 comprises an input transducer 310 like a microphone for converting input sound signals in electrical signals, an amplifier 305 constituting the electronics of the hearing aid and consisting of various circuit elements for processing the electrical signal from microphone 310 according to the fitting rules and the applicable gain of the hearing aid to produce an electrical output signal, and an output transducer 320 for converting the electrical output signal to an output sound signal which is then transmitted through the ear canal 350 to the ear drum 355 of the user. The hearing aid 300 further comprises an ear plug 330 with a ventilation canal 340. It may be apparent to those skilled in the art that the hearing aid and in particular the hearing aid plug and the anatomy of the user are illustrated in schematic form only. In FIG. 2 it is also shown that besides the actual ventilation canal there is a further leakage 345 between the wall of the ear canal 350 and the ear plug 330 which contributes to the overall effective vent diameter.

According to an embodiment, system 200, when equipped as a computer, may preferably further comprise a display screen and at least one input device for displaying, e.g. the audiogram, inputting parameters and instructions to control the fitting routine by the audiologist. When the fitting routine program 245 is run by the system 200 the fitting routine program first carries out the measured feedback test by introducing an electrical input to the receiver or amplifier to generate a sound pressure via output transducer 320 and then measuring the sound pressure at a certain distance from the exterior opening of the vent 340. The measured loop gain values 250 are then stored in working memory 220 and used to estimate the effective vent diameter by means of the modelled loop gain values stored in tables 215. The estimated effective vent diameter values 255 are then stored in working memory 220 and used to derive vent effect values 260 also stored in working memory 220. A necessary hearing aid gain value derived from the audiogram to compensate for the hearing loss are then corrected by means of the vent effect values to produce corrected hearing aid gain values 265. The corrected hearing aid gain values for the respective frequency ranges are then uploaded to the hearing aid 300 via transmission means 270 which is, for example, an electrical cable connecting the hearing aid 300 with the system 200 for exchanging data. Then, the corrected gain values may be used by the amplifier 305 to produce amplified output signals to compensate for the hearing loss followed by possible further fine tuning of the hearing aid according to further fitting rules and the personal hearing impression of the user.

With reference to FIGS. 4*a* to 4*c*, the estimation of the best fit acoustic model of the in-situ hearing aid by modelling a performed measurement with transmission line theory will be described.

FIG. 4*a* illustrates in principle an equivalent circuit of the transfer function for modelling of the vent effect. The vent effect is calculated as the dB difference between an earplug 455 with a vent 415 and an acoustically sealed earplug, and accounts for the changes in the sound pressure at the ear drum 445 when a ventilation canal is drilled through the ear plug 455 in the ear canal 440. The sealed condition is a theoretic condition, which is not measured, so leakage is not relevant here. The changes in sound pressure of sound provided through tube 450 (see arrow) are calculated at the middle of the ear drum 445 illustrated by microphone 425. The respective transfer function may be represented by an equivalent circuit diagram 410.

FIG. 4*b* illustrates in principle the equivalent circuit of the transfer function for the modelling of the direct transmission gain of the direct transmitted sound from the outside of the vent ventilation canal opening 415 to the middle of the ear drum 445 illustrated by microphone 425 as illustrated by the arrow. The direct transmission gain is the amplification of sound arising from the transmission from the surroundings directly through the vent 415 to the middle of the ear drum 445. The respective transfer function may be represented by equivalent circuit diagram 420.

FIG. 4*c* illustrates in principle an equivalent circuit of the transfer function for the modelling of the acoustic part of the loop gain from the electrical input of the receiver (not shown) to the sound pressure at a distance of e.g. 2 cm from the exterior vent opening measured by microphone 435. The sound pressure provided by the receiver is supplied to the ear drum 445 by tube 450 (see arrow). The respective transfer function may be represented by equivalent circuit diagram 430.

A further method according to an embodiment will now be described. At first, the hearing threshold level (HTL) is measured in respective frequencies which may then be recorded by an audiogram which, for example, shows a hearing loss of 40 dB at 1.000 Hz. Next, the loop gain is measured by applying a measured feedback test which is routinely performed during fitting for determining the maximum possible hearing aid gain without feedback.

The modelled loop gain may be calculated by use of transmission line theory in a simulation process beforehand. During the modelled feedback test, the acoustic system is simulated in, for example, 15 frequency bands by modelling the entire acoustic system. The modelling of the acoustic system is done by input or assumption about the parameters of the acoustic systems. Parameters to be used in the modelling are, for example, receiver type, dimensions of the sound canal, ear canal size and geometry, insertion depth of the hearing aid, middle ear properties, length of the ventilation canal and distance between vent opening and the hearing aid microphone. These parameters are either known, such as the receiver type, or taken as an average value over a population (e.g., children, men or women). In this way, the invention provides a possibility to correct for various hearing aid types, such as BTE (behind the ear), ITE (in the ear), CIC (completely in the canal), etc.

According to an embodiment of the present invention, standard parameters for the various hearing aid types are used in the model, since such an approach allows for usage of pre-calculated tables thereby reducing the calculation time or necessary computation power. According to another embodiment, the modelling and simulation calculations are implemented by application of individually adapted parameters in order to get a precise model taking the individual parameters into account.

The simulation of the modelled acoustic system is carried out for different values of a vent parameter. The result of the simulation is a table comprising modelled loop gain values for a number of values of the vent parameter in each frequency band. A table look up is then carried out to identify that value of the vent parameter that generates the best fit between the modelled and the measured feedback test by comparing the modelled and measured loop gain values. The identified best fitting value of the vent parameter is then defined as the effective vent parameter.

Based on the identified effective vent parameter, the vent effect is calculated by use of the same parameters as applied in the modelled feedback test and the effective vent parameter. According to an embodiment, also for the calculation of the vent effect values in each frequency band, standard parameters for the various hearing aid types are used since this allows for usage of pre-calculated tables thereby again reducing the calculation time or necessary computation power. Of course, according to another embodiment, the vent effect may be calculated directly by application of individually adapted parameters.

Since an audiogram is often recorded by using loudspeakers instead of hearing aids to produce the tones for the hearing test, the audiogram does not need to be corrected according to the vent effect. However, if an in-situ audiogram is used for the hearing test the in-situ audiogram needs to be corrected, since the in-situ fitting system usually assumes that the test is performed with a sealed ear plug. The measured in-situ audiogram for a vented ear plug should therefore be corrected for the vent effect as, e.g., described with reference to FIG. 5. The correction then gives the hearing loss for the closed ear plug, which may then be used for calculating the hearing aid gain according to the applicable fitting rules.

In a next step, the hearing aid gain is calculated according to the measured hearing threshold level and the applicable fitting rules to compensate for the hearing loss.

In addition to the vent effect, also the direct transmission gain is calculated by use of the same parameters as applied in the modelled feedback test and the effective vent parameter in each of the frequency bands. Also here, it would be advantageous to use standard parameters for the various hearing aid types allowing the usage of pre-calculated values but, according to an embodiment, the calculation can also been done directly by applying individually adapted parameters.

Since according to the vent effect in particular the low frequency sound pressure is reduced due to the vent, the hearing gain is corrected with the vent effect in order to provide enough gain to compensate for the hearing loss. The hearing aid gain is further corrected according to the determined direct sound transmission by a corresponding direct transmission gain. In particular, if a person has a limited hearing loss in the low frequencies, the direct transmitted sound through the vent will mix with the hearing aid sound and generate interference. The hearing aid gain therefore needs to be corrected not only with the vent effect but also with respect to the direct transmission gain. According to an embodiment the correction of the hearing aid gain is done by carefully considering the effects of the vent effect and the directly transmitted sound, how the two sources may interfere, and how to avoid mixing of the sources or sounds.

Figure 5A:
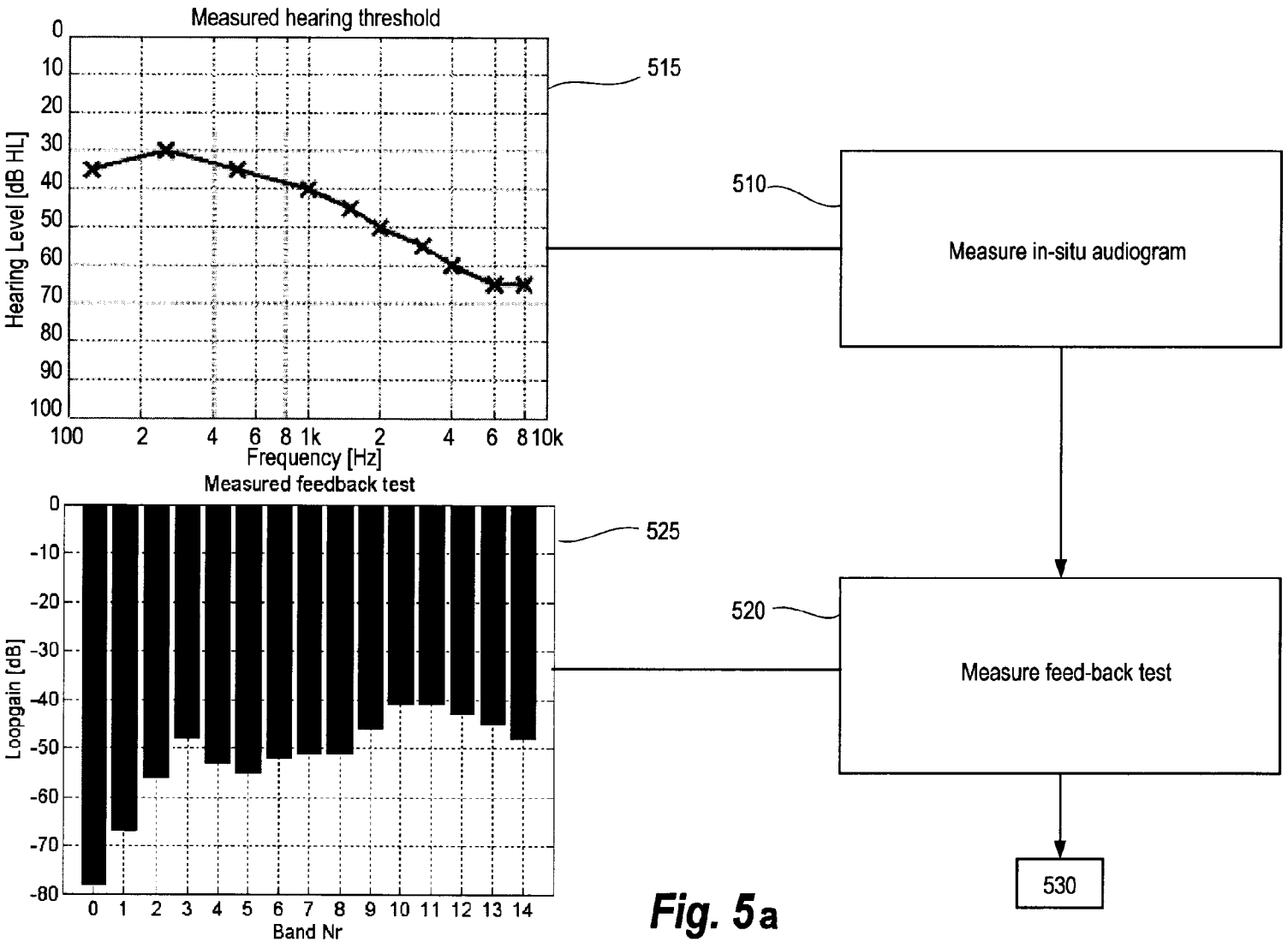
FIG. 5*a* illustrates a flow diagram in a method for correcting the in-situ audiogram comprising steps for measuring in-situ audiogram and feedback test.
Figure 5B:
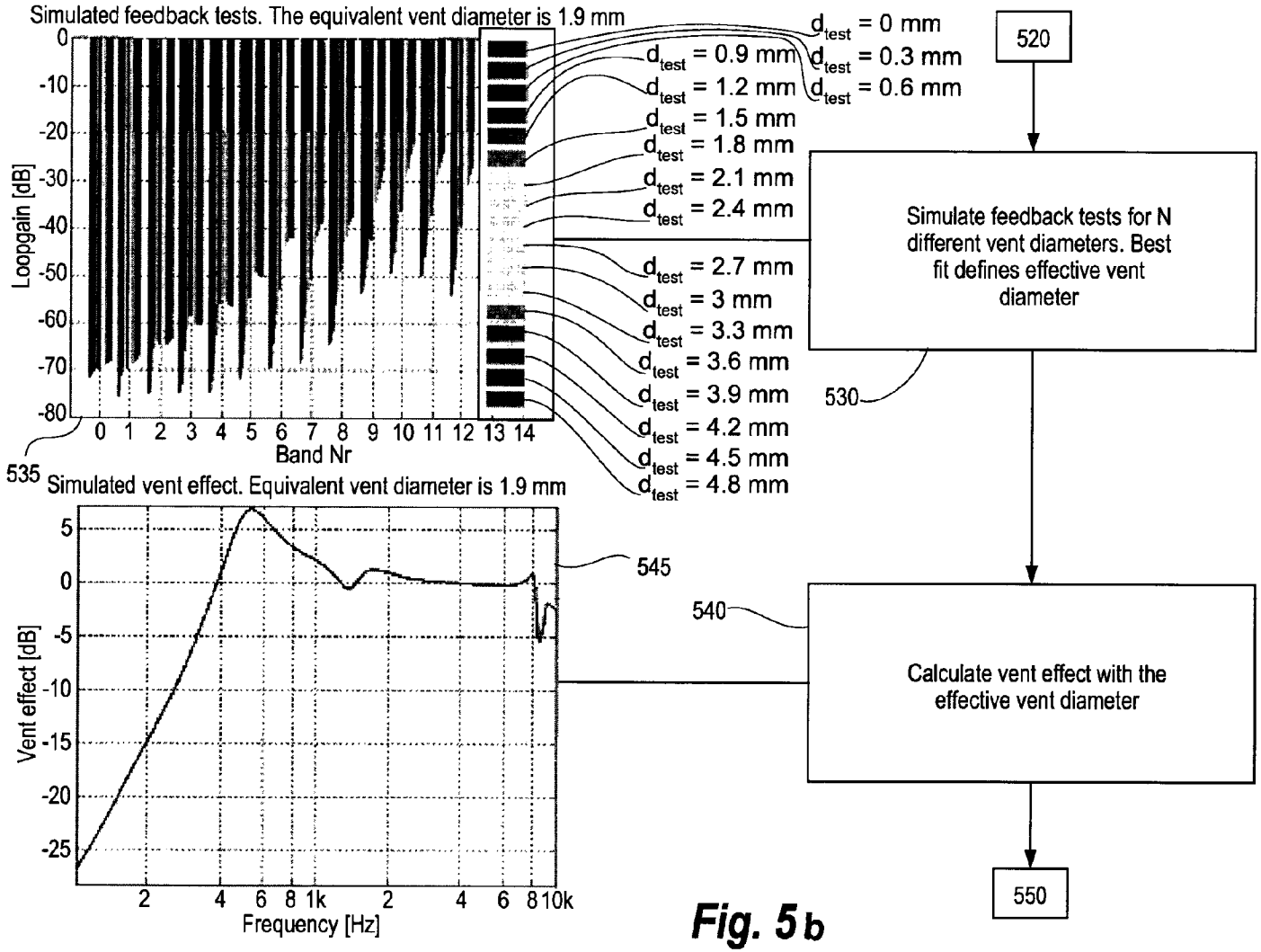
FIG. 5*b* illustrates a flow diagram in a method for correcting the in-situ audiogram comprising steps for defining the effective vent diameter.
Figure 5C:
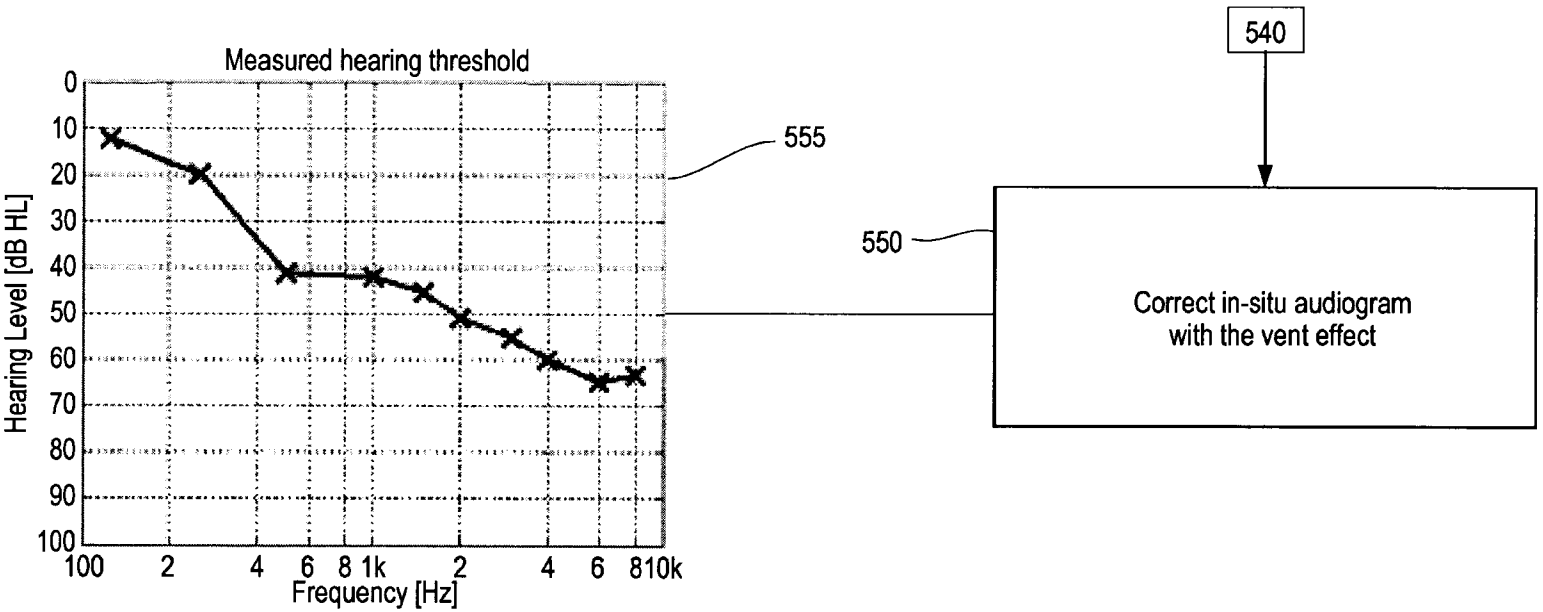
FIG. 5*c* illustrates a flow diagram in a method for correcting the in-situ audiogram comprising steps for correcting the in-situ diagram.
Figure 6A:
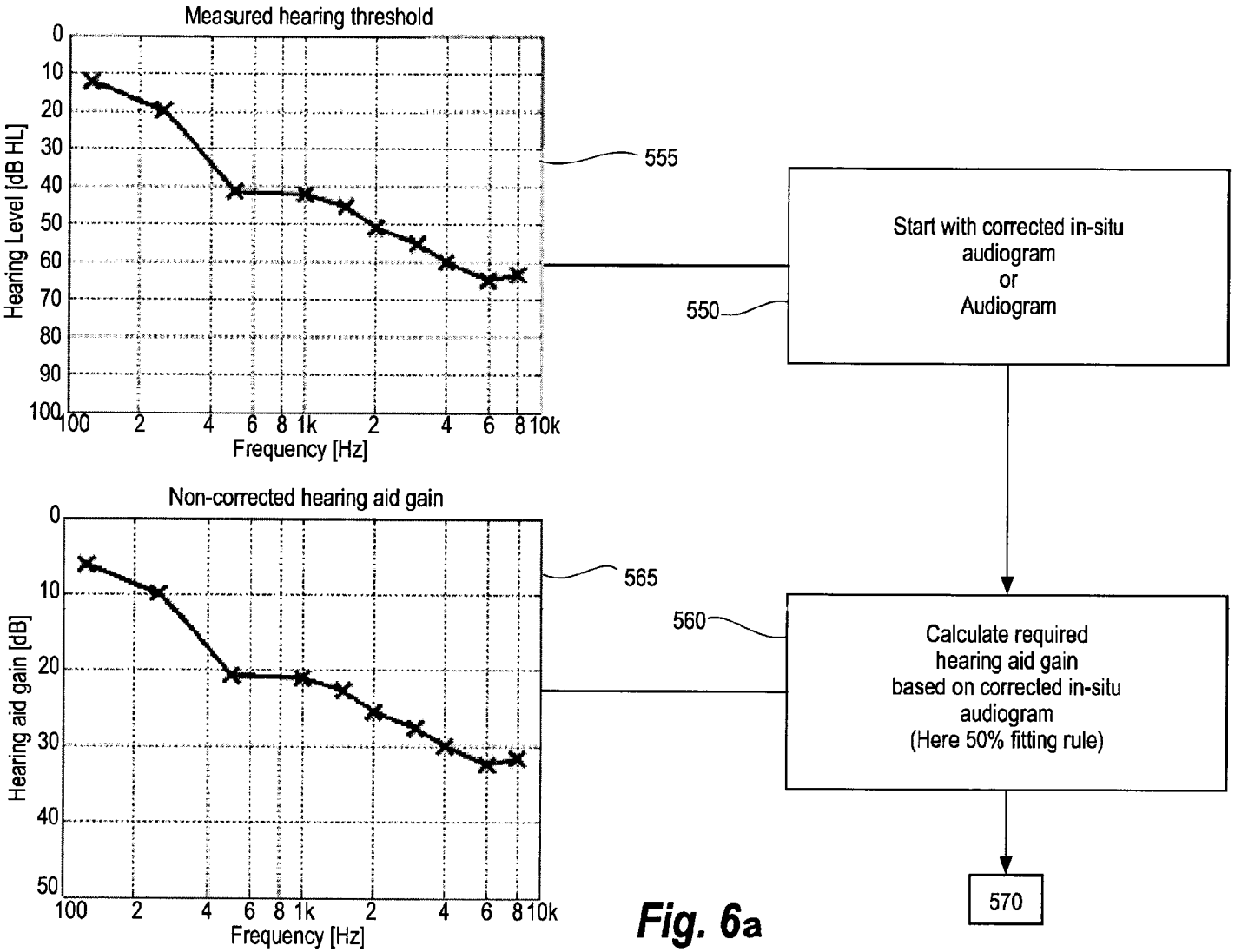
FIG. 6*a* illustrates a flow diagram of a method to correcting the in-situ audiogram comprising steps for calculating the gain.
Figure 6B:
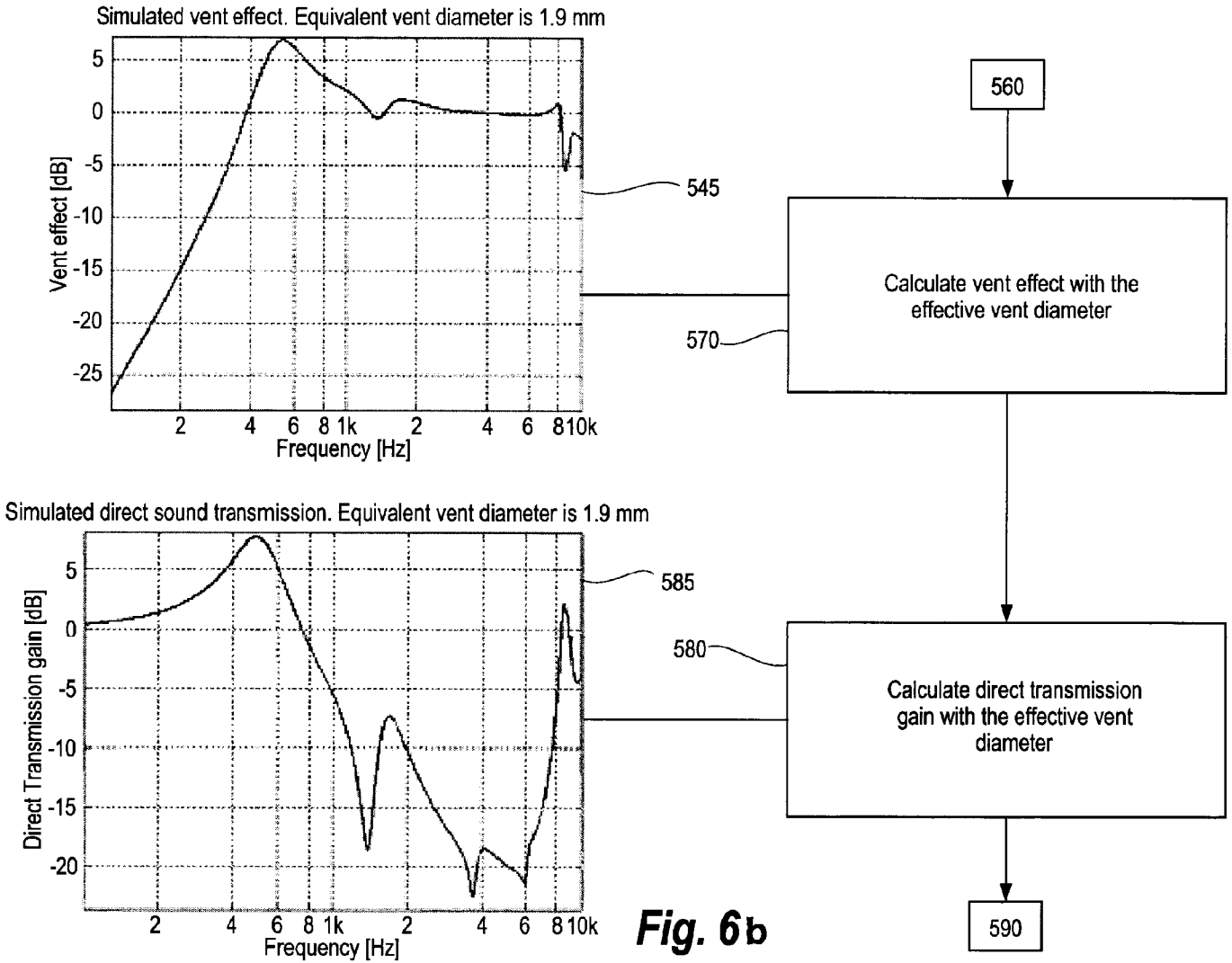
FIG. 6*b* illustrates a flow diagram of a method to correcting the in-situ audiogram comprising steps for calculating the vent effect.
Figure 6C:
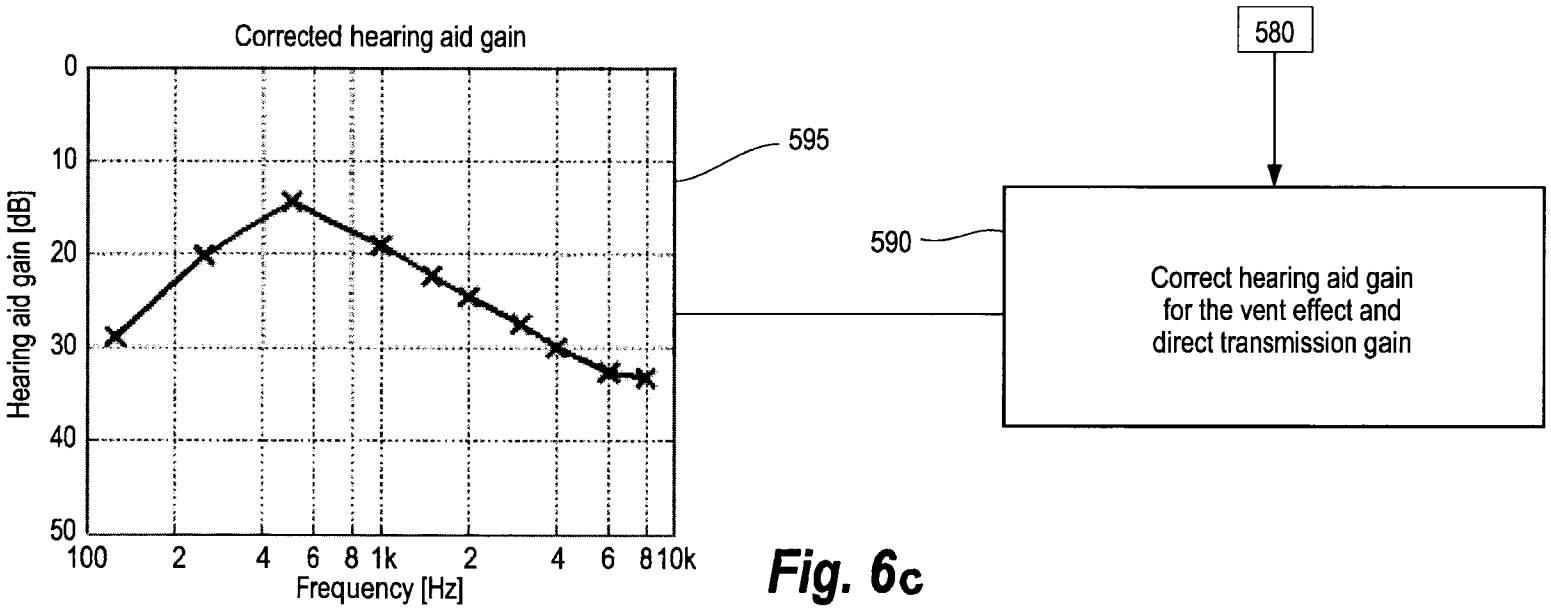
FIG. 6 *c* illustrates a flow diagram of a method to correcting the in-situ audiogram comprising steps for correcting for the direct transmission gain.

FIGS. 5 and 6 now illustrate flow diagrams of methods according to further embodiments of the present invention. FIG. 5 explains step by step how the in-situ audiogram is corrected for the vent effect. FIG. 6 explains step by step how the hearing aid gain is corrected for the vent effect and the direct sound.

In the following example the measured feedback test is applied as the measured transfer function containing the leakage path. The vent parameter is here the vent diameter. The calculated transfer functions include the vent effect and the direct transmission gain.

The individual method steps are illustrated together with respective diagrams of measurement or simulation results in this step. All the data in the diagrams are frequency dependent and the example used when describing the flow diagram in the following concentrates on the measurements at 250 Hz.

In a first group of steps 510 to 550, the hearing loss is measured and the measurement is corrected for the vent effect. In step 510, an in-situ audiogram is measured to get the hearing threshold level of the hearing impaired person. According to the example, using the in-situ audiogram, the hearing loss is measured to $HTL_{measured}$=30 dB HL at 250 Hz in diagram 515. In next step 520, the feedback test is measured and the loop gain in each frequency band is illustrated in diagram 525. The feedback test is also simulated for N different vent diameters in step 530. The best fit between the measured and the one of the simulated feedback tests defines the effective vent diameter with the best equivalent of the actual ventilation canal and the leakage in the ear canal. In the example, the equivalent vent diameter is 1.9 mm (diagram 535). The vent effect is then calculated in step 540 based on the equivalent vent diameter. The simulated frequency dependent vent effect is shown in diagram 545. With the vent effect, the in-situ audiogram is now corrected in step 550 and the corrected in-situ audiogram is shown in diagram 555.

Using the method defined in steps 510 to 550, the vent effect at 250 Hz is estimated to Vent Effect=−10 dB (in diagram 545 at 250 Hz). This means that the hearing aid produces a tone in the ear, that is 10 dB lower than expected, so the actual sound pressure at the eardrum when measuring the hearing threshold is:

$$HTL\text{corrected}=HTL\text{measured}+\text{Vent Effect}=30+(-10)=20\text{ dB HL}$$

This is thus the corrected hearing threshold.

In a second group of steps 560 to 590, the needed gain in the hearing aid is then calculated using the corrected hearing threshold as provided in step 550 and diagram 555. Moreover, the gain is also corrected for the vent effect. According to another embodiment, when an audiogram is used, instead of an in-situ audiogram, the method starts with step 550 based on the hearing threshold recorded by the audiogram.

In step 560, based on the corrected in-situ audiogram, a 50% fitting rule is used to calculate a hearing aid gain based on the corrected in-situ or non-corrected normal audiogram. The 50% fitting rule, which is used as an example here and could naturally be any other fitting rule, prescribes a 50% compensation of the hearing loss, with a hearing loss at 250

Hz of 20 dB as illustrated in diagram 565, the real gain Greal should be:

$$Greal = HTL\text{corrected}*50\% = 20*0.5 = 10\text{ dB}$$

As the in-situ hearing aid is going to be used in the same acoustic environment as set up when measuring the hearing loss and estimating the vent effect, it is also known that the hearing aid underestimates its produced output sound level by Vent Effect=−10 dB. To compensate for that, and thus to obtain the needed real life gain of 10 dB, the hearing aid gain Gha is further corrected by the vent effect in step 570, so:

$$Gha = HTL\text{corrected}*50\% - \text{Vent Effect} = 20*0.5 - (-10) = 20\text{ dB}$$

In the same way, it can be shown that if the vent effect is not taken into account it will result in an erroneous hearing threshold of 30 dB HL, which leads to a required gain of 15 dB. With this gain setting applied to the hearing aid, the resulting gain, due to the vent effect, will be 5 dB, i.e. less than required.

Furthermore, the direct sound transmission gain in the hearing aid is calculated in step 580 and illustrated in diagram 585. To compensate for the direct sound transmission, the direct sound is compared to the sound through the hearing aid, and measures are taken if they are comparable. As a result, a hearing aid gain is corrected for the vent effect and the direct sound transmission, and is ready to be applied to the hearing aid. Thus, methods and systems are provided according to which a hearing aid may be individually fitted not only based on the measured hearing threshold but also on the vent effect.

Figure 3:
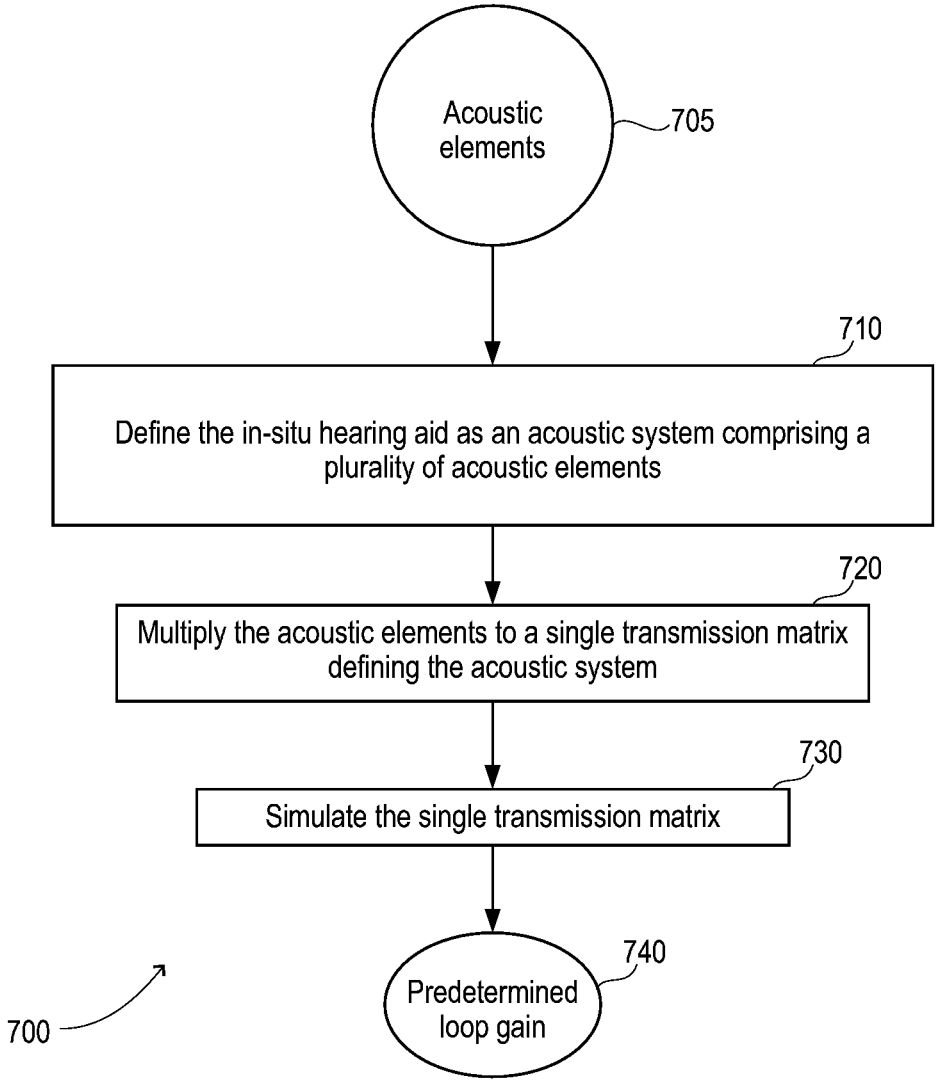
FIG. 3 is a flow diagram of a method for modelling a transfer function according to an embodiment of the present invention.

A method according to a further embodiment of the present invention is now explained with reference to FIG. 3, which shows a flow diagram 700 of a method for calculating the modelled transfer function. First, acoustic elements 705 are selected as those elements which are part of the in-situ hearing aid to be modelled. The in-situ hearing aid is then defined as an acoustic system that consists of these acoustic elements 705 in step 710. The acoustic elements are multiplied to a single transmission matrix defining the acoustic system in step 720. In step 730, the single transmission matrix is then simulated resulting in the predetermined loop gain 740. During simulation, a single parameter as the vent parameter is changed in the acoustic elements to receive a transfer function for e.g. N different values of the vent parameter. The such modelled transfer functions may then be used in the step of determining the best fitting transfer function.

According to an alternative embodiment of the present invention, a method for fitting a hearing aid gain is provided which comprises steps carried out for at least one frequency band of measuring a transfer function of an in-situ hearing aid including a leakage path, estimating an effective vent parameter for the hearing aid by determining that value of said vent parameter as effective vent parameter that provides the best fit between a modelled and the measured transfer function, calculating a correction gain based on said effective vent parameter, correcting said hearing aid gain by means of said correction gain.

A computer system carrying out this method is normally applied in a fitting situation in which the hearing aid to be fitted is inserted in the ear canal of the hearing aid user and is also connected to the computer system which comprises executable program code for carrying out a fitting routine. The program code executed on the computer system includes program portions for measuring a transfer function of an in-situ hearing aid including a leakage path, for estimating an effective vent parameter for the hearing aid by determining that value of said vent parameter as effective vent parameter that provides the best fit between a modelled and the measured transfer function, for calculating a correction gain based on said effective vent parameter, and for correcting said hearing aid gain by means of said correction gain. This fitting routine may also be carried out for a number of frequency bands.

Methods and systems according to embodiments of the present invention may be implemented in any suitable data processing system like a personal computer or workstation used by, e.g., the audiologist when fitting a hearing aid. Methods according to the present invention may also be implemented in a computer program containing executable program code executing methods according to embodiments described herein. If a client-server-environment is used, an embodiment of the present invention comprises a remote server computer which embodies a system according to the present invention and hosts the computer program executing methods according to the present invention. According to another embodiment, a computer program product like a computer readable storage medium, for example, a floppy disk, a memory stick, a CD-ROM, a DVD, a flash memory, or any other suitable storage medium, is provided for storing the computer program according to the present invention.

According to a further embodiment, the program code may be stored in a memory of a digital hearing device or a computer memory and executed by the hearing aid device itself or a processing unit like a CPU thereof or by any other suitable processor or a computer executing a method according to the described embodiments.

Having described and illustrated the principles of the present invention in embodiments thereof, it should be apparent to those skilled in the art that the present invention may be modified in arrangement and detail without departing from such principles. Changes and modifications within the scope of the present invention may be made without departing from the spirit thereof, and the present invention includes all such changes and modifications.

We claim:

1. A method for fitting a gain of a hearing, comprising the following steps for at least one frequency band:

measuring a loop gain of an in-situ hearing aid;

estimating an effective vent parameter for the hearing aid by determining that vent parameter as said effective vent parameter that provides the best fit between a number of predetermined loop gains and the measured loop gain;

calculating a correction gain based on said effective vent parameter; and correcting the gain of said hearing by means of said correction gain.

2. The method according to claim 1, wherein the predetermined loop gain is obtained by modelling an in-situ measurement of a transfer function of said hearing aid.

3. The method according to claim 1, wherein the predetermined loop gain is provided by a feedback test.

4. The method according to claim 1, wherein the step of calculating said correction gain comprises calculating a vent effect according to said effective vent parameter, which is then used as said correction gain.

5. The method according to claim 1, wherein the step of calculating said correction gain comprises calculating a direct transmission gain according to the effective vent parameter, which is then used as said correction gain.

6. The method according to claim 1, wherein the method is carried out in a plurality of frequency bands.

7. The method according to claim 2, wherein the step of:

modelling an in-situ measurement of a transfer function, comprises the step of:

defining the in-situ hearing aid as an acoustic system comprising a plurality of acoustic elements.

8. The method according to claim 7, wherein said acoustic system comprises a plurality of acoustic elements and each of said acoustic elements defines an element selected from a group comprising receiver, sound canal, ear canal, ear drum, ventilation canal, and distance between ventilation canal exit and the hearing aid microphone.

9. The method according to claim 1, further comprising the step of measuring at least one hearing threshold level of a hearing aid user.

10. The method according to claim 9, further comprising: calculating said hearing aid gain based on the hearing threshold level; and wherein said corrected hearing aid gain is calculated by summing said calculated hearing aid gain and said correction gain.

11. The method according to claim 9, wherein said hearing threshold level is measured by an in-situ audiogram, and said measured in-situ audiogram subsequently is corrected by means of said correction gain.

12. The method according to claim 11, wherein said hearing aid gain is calculated based on the corrected in-situ audiogram.

13. The method according to claim 1, wherein the predetermined loop gain is simulated for a number of vent parameters.

14. The method according to claim 1, wherein said vent parameter is one or a combination of the vent diameter, the vent length, the insertion depth in the ear canal, or the ear canal volume.

15. The method according to claim 1, wherein standard parameters for the predetermined loop gain, vent effect and direct transmission gain are used that are selectable from pre-calculated tables depending on the hearing aid type and predefined vent parameters.

16. The method according to claim 1, wherein individually adapted parameters for the predetermined loop gain, vent effect and direct transmission gain are used that are calculated individually depending on measured vent parameters and the used hearing aid type.

17. A computer program product comprising a non-transitory computer readable medium containing executable program code which, when executed on a computer, executes a method for fitting a hearing aid gain, comprising the following steps for at least one frequency band:

measuring a loop gain of an in-situ hearing aid;

estimating an effective vent parameter for the hearing aid by determining that vent parameter as said effective vent parameter that provides the best fit between a number of predetermined loop gains and the measured loop gain;

calculating a correction gain based on said effective vent parameter; and correcting said hearing aid gain by means of said correction gain.

18. A system for fitting a hearing aid which is configured to carrying out a method for fitting a hearing aid gain, comprising the following steps for at least one frequency band:

measuring a loop gain of an in-situ hearing aid;

estimating an effective vent parameter for the hearing aid by determining that vent parameter as said effective vent parameter that provides the best fit between a number of predetermined loop gains and the measured loop gain;

calculating a correction gain based on said effective vent parameter; and correcting said hearing aid gain by means of said correction gain.

19. A hearing aid adapted for carrying out a method for fitting a hearing aid gain, comprising the following steps for at least one frequency band:

measuring a loop gain of an in-situ hearing aid;

estimating an effective vent parameter for the hearing aid by determining that vent parameter as said effective vent parameter that provides the best fit between a number of predetermined loop gains and the measured loop gain;

calculating a correction gain based on said effective vent parameter; and correcting said hearing aid gain by means of said correction gain.

20. A computer system adapted for being connected to a hearing aid for fitting a hearing aid gain, comprising executable program code including:

a program portion for measuring a loop gain of an in-situ hearing aid;

a program portion for estimating an effective vent parameter for the hearing aid by determining that vent parameter as effective vent parameter that provides the best fit between a number of predetermined loop gains and the measured loop gain;

a program portion for calculating a correction gain based on said effective vent parameter; and a program portion for correcting said hearing aid gain by means of said correction gain.

* * * * *